US005319818A

United States Patent [19]

Baranowski

[11] Patent Number: 5,319,818

[45] Date of Patent: Jun. 14, 1994

[54] ACCESSIBILITY MEANS FOR A PERSON USING A WHEELCHAIR

[76] Inventor: Edwin M. Baranowski, 75 Marrus Dr., Gahanna, Ohio 43230

[21] Appl. No.: 826,838

[22] Filed: Jan. 27, 1992

[51] Int. Cl.[5] ..... E01D 1/00

[52] U.S. Cl. ..... 14/71.1; 414/522

[58] Field of Search ..... 14/2.4, 69.5–71.1; 414/522, 537–540, 495, 921

[56] References Cited

U.S. PATENT DOCUMENTS

| | | | |
|---|---|---|---|
| Re. 31,178 | 3/1983 | Deacon . | |
| 3,874,527 | 4/1975 | Royce | 14/71.1 |
| 3,913,759 | 10/1975 | Deacon | 214/77 R |
| 4,061,089 | 12/1977 | Sawyer | 104/23 FS |
| 4,109,885 | 8/1978 | Pender | 244/7 R |
| 4,247,127 | 1/1981 | Wilkes | 280/28.5 |
| 4,325,668 | 4/1982 | Julian et al. | 414/546 |
| 4,368,898 | 1/1983 | Lay | 280/289 WC |
| 4,407,624 | 10/1983 | Kingston | 414/546 |
| 4,438,830 | 3/1984 | Born | 187/12 |
| 4,441,710 | 4/1984 | Lay | 273/54 R |
| 4,482,284 | 11/1984 | Robbins et al. | 14/69.5 X |
| 4,483,653 | 11/1984 | Waite | 414/541 |
| 4,488,326 | 12/1984 | Cherry | 14/69.5 |
| 4,566,707 | 1/1986 | Nitzberg | 180/8.2 |
| 4,576,539 | 3/1986 | Williams | 414/391 |
| 4,667,955 | 3/1987 | Giesch . | |
| 4,712,264 | 12/1987 | Voith | 14/69.5 |
| 4,768,497 | 9/1988 | Winge | 128/25 R |
| 4,807,317 | 2/1989 | Quinn et al. | 14/69.5 |
| 4,807,897 | 2/1989 | Schultz | 280/250 |
| 4,898,256 | 2/1990 | Lehner | 180/8.2 |
| 4,984,955 | 1/1991 | McCullough | 414/346 |
| 5,010,614 | 4/1991 | Braemert et al. | 14/71.1 |
| 5,026,243 | 6/1991 | Dell | 414/537 X |
| 5,040,936 | 8/1991 | Rhen | 414/540 |
| 5,077,852 | 1/1992 | Karlsson | 414/537 X |

OTHER PUBLICATIONS

Advertisement, Portable Folding Ramp, "Instant Access" (undated).

*Primary Examiner*—Kenneth J. Dorner
*Assistant Examiner*—Nancy Mulcare

[57] ABSTRACT

Accessibility means for achieving the assisted passage of a person using a wheelchair, while in the chair, over a barrier including a pair of spaced-apart pathways which permit the transit of an assistant between the pathways as the assistant assists the wheelchair and occupant over the barrier.

24 Claims, 3 Drawing Sheets

ACCESSIBILITY MEANS FOR A PERSON USING A WHEELCHAIR

FIELD OF THE INVENTION

This invention relates to accessibility means for wheelchair users. The invention provides a convenient way for a person using a wheelchair, while in the chair, to overcome a barrier, such as a stairway, which prevents access to a location that is otherwise accessible to able bodied persons.

BACKGROUND OF THE INVENTION

Responding to an enlightened view of "disability," contemporary social attitudes recognize, and recently enacted civil rights legislation requires, that many heretofore inaccessible by wheelchair places of business, recreation and residence be made accessible to persons using wheelchairs.

The prior art apparatus includes ramps, lifts, elevators and the like; all of which are expensive, and may require structural deviations from historically appropriate architectural preferences. These devices provide "barrier free" accessibility for singly independent wheelchair bound persons and are most appropriate for new construction and significant renovation of existing structures.

In many applications, wheelchair access is not required 100% of the time; or the scale of a facility or residence does not, or resources available do not, warrant extensive renovation or expense.

It is an object of this invention to provide a retrofittable accessibility system that is easily installed on site, inexpensive, can be retracted when not in use and is conveniently adapted to existing architecture and decor.

It is a further object to provide in an alternative embodiment an accessibility means that is conveniently portable and optimally adapted for use, for example, on social occasions when a wheelchair bound person visits a friend or a residence at a location that has a wheelchair access barrier, such as stairs; and as an extension of that alternative, to provide an inexpensive access means that the friend or residence can provide upon the spontaneous visit of a wheelchair bound person.

The availability of the device of this application should not be regarded as an excuse in new construction to not utilize state of the art "barrier free" design techniques. The availability of the present apparatus should, however, eliminate any possibility for an excuse that wheelchair access should not, as a retrofit or in a prospective design, be installed for reasons of expense, aesthetics or impracticability.

Nevertheless, the design of the application is not a universal solution. The present device may not in most instances permit fully independent access. In many instances, assistance will be required to help the person using a wheelchair, while in the chair, over or across the barrier at which the accessibility means is installed. The need for assistance will typically not be a problem because the accessibility means will normally be used at locations where assistance is already available, such as in restaurants where there are waiters or a maitre d'; or in doctors', dentists' or attorneys' or other professional offices which are attended by receptionists; apartment buildings attended by doormen; swimming pools attended by a life guard; or in small businesses where other persons are present. On social occasions at private residences, obviously other people will be present and available.

The degree of skill and strength required for the assisted use of the access means over a barrier is less than that required in the transit of the wheelchair and its occupant over the same barrier without the use of the access means.

The object of the invention is to provide a cost effective, convenient access means that overcomes physical barriers for wheelchair users. The device is retrofittable to old, barrier containing construction, is economically suited for premises that are infrequently visited by wheelchair users, and is a facilitator which will make the concept of wheelchair access more easily accepted and more easily achieved in a reasonable manner.

The invention will be more readily understood with reference to the following description of the preferred embodiment and the drawings in which:

BRIEF DESCRIPTION OF THE DRAWINGS

FIG. 4 illustrates in side view the bi-functional mechanisms achieved, by the deployed access means.

DESCRIPTION OF THE PREFERRED EMBODIMENT

Figure 1:
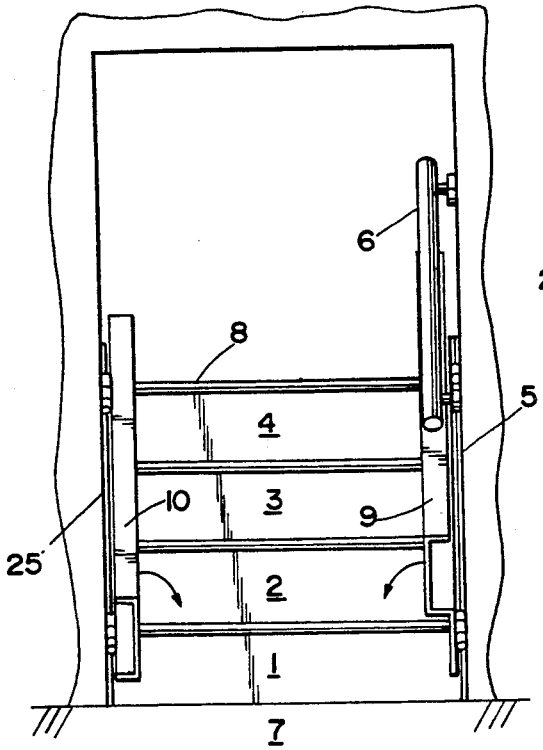
FIG. 1 shows the access means in a folded state installed in a hallway having four (4) stairs.

The invention adapts a separated pair of pathways, which may be two generally "U"-shaped channels, to provide assisted wheelchair accessibility over a barrier which may be a set of stairs, the space between a dock and a boat deck, the drop between a deck and a beach, the entrance to a vehicle or any other limited physical barrier which obstructs the passage of a wheelchair, but which is passable by an able bodied person. Because many wheelchairs have offset front and rear wheels, the width of each side pathway/channel must accommodate the widths of both side wheels plus the offset distance between the wheels. An approximate six inch (6.0") pathway (on each side) is appropriate in most instances. Stainless steel, aluminum, galvanized or painted steel, or other metal, polymer and wood materials are suitable, depending upon the application and the environment of use. The pathways may be appropriately fabricated, molded, extruded or otherwise formed. As shown in the drawings, an open grid material may be used; or the upper surface of the channels may be covered, or integrally formed, with a traction enhancing surface.

Depending upon the environment of use, the spacing between the channels can be fixed, for example, when the accessibility means is dedicated to a single individual's use and wheelchair, or variable, for example, when the system is used in a restaurant, or a public swimming pool, and many differently configured wheelchairs are expected to be encountered. When the separation distance between the channels is fixed, the widths of the separate channels can be adapted to provide a universal, spacing. Eight inch (8.0") channels spaced apart fourteen inches (14.0") would likely accommodate most existing wheelchairs. Alternatively, the spacing of the channels can be made adjustable by extension means such as a slide or scissor apparatus connecting the two channels.

An offset of the channels from an existing wall or railing is preferred—to provide an adequate clearance for comfortable operation, to avoid scraped knuckles, to eliminate a claustrophobic feeling—or most simply to replicate the positioning of an able bodied person who, when traversing a stairway does not usually cling to a sidewall or rail, but instead walks in the center of the stairway or other barrier. If the apparatus is used in a narrow hallway with stairs, the offset is dependent on total width available.

Because an assistant is usually required in the utilization of the invention, a "step thru" width between the channels is provided as illustrated in the drawings. Unlike a full width ramp, the invention preserves the security of stair footing for an able bodied assistant and provides the leverage inherent in an inclined plane to facilitate the contemporaneous movement of a wheelchair across a barrier. In the example of a stair barrier, conventional assistance techniques usually prescribe two or more persons, at the front and back of a chair to lift and carry a person while in a wheelchair up or down a stairway or other like obstacle. Many persons unfamiliar with such techniques become confused, may strain themselves as a result of improper lifting techniques or may otherwise create a condition hazardous to themselves and/or the wheelchair occupant in an effort to be helpful. With this consideration in mind, an object of the invention is to reduce confusion and strain and facilitate the traverse of barriers in a manner naturally appropriate both to able bodied assistants and to wheelchair transport requirements.

FIG. 1 shows an installation at a hallway stair in the operational state. In the application shown in this figure, the installation is made at the clubhouse of a social association in an historical district. The clubhouse is an old building with the most convenient entry for wheelchair access being a side service door adjacent the parking lot. The service door has an intercom which the wheelchair bound visitor can use to signal the building attendant. The door opens into a hallway 44 inches wide that includes a stairway having four stairs, shown in FIG. 1 as 1, 2, 3 and 4. The sidewall 5 has a railing 6 attached; and the stairs lead from the ground level 7 to the main clubhouse floor 8. The access means comprises right pathway section 9 and corresponding left pathway section 10, affixed to the hallway walls 5 and 25. The sections include therein accessibility channels which provide pathways for the side wheels of the wheelchair; and the sections are hinged to the respective sidewalls. The hinges are connected to wall studs or other suitable support means which permanently maintain the access means sections at the stairway location.

Figure 2:
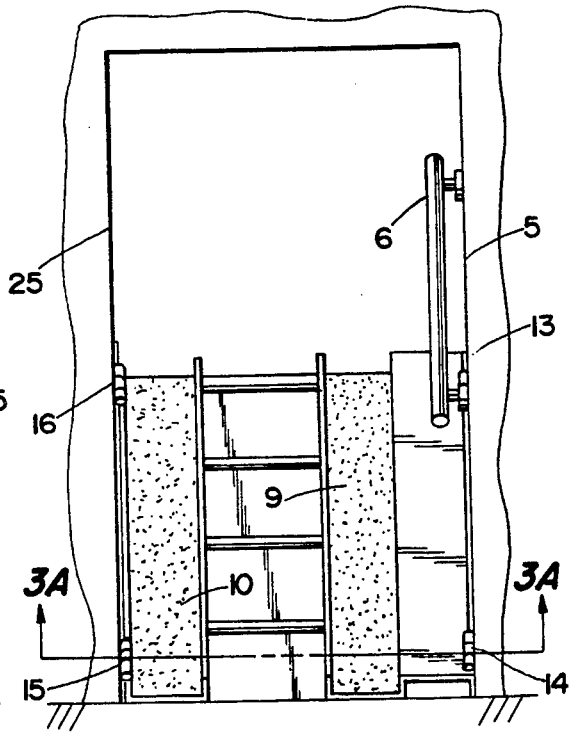
FIG. 2 shows the access means unfolded.
Figure 3:
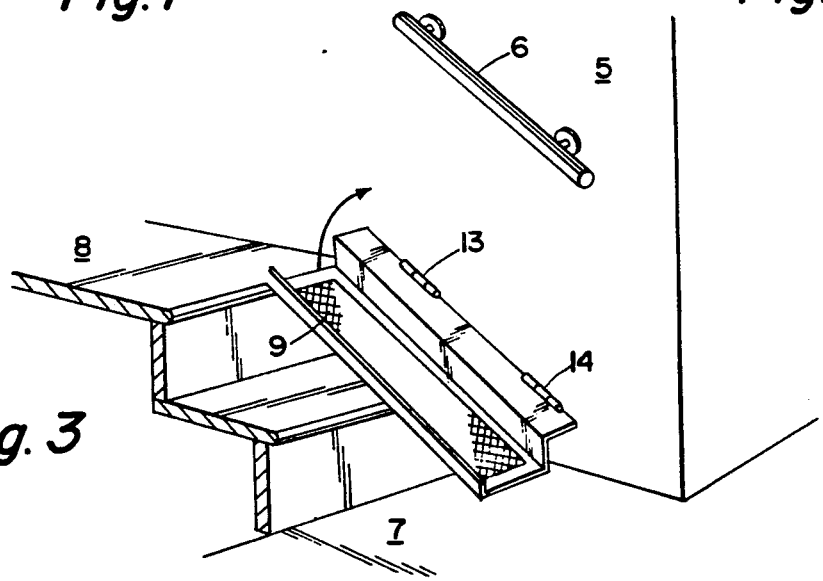
FIG. 3 is a perspective view of the unfolded access means on one side of the stairway.
Figure 3A:
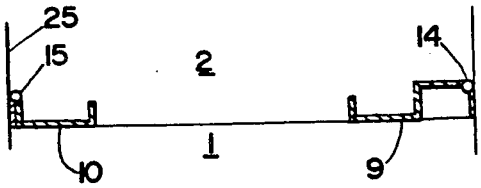

As shown in FIG. 2 the pathway sections 9 and 10 are unfolded from the walls 5 and 25 on the hinges 13, 14, 15 and 16 when wheelchair access is required. The unfolding and retraction can be manual, or powered electrical, mechanical or pneumatic means can be provided. With reference to FIG. 2, the channel on the right side of the stairs is offset from the wall so that transport of the wheelchair is not hindered or obstructed by the banister or railing 6. FIG. 3 is a perspective view of the right side of the access means installation shown in FIGS. 1 and 2. FIG. 3A is a cross-section through the means at section 3A—3A of FIG. 2 showing pathway sections 9 and 10 and hinges 14 and 15 attached to wall sections 5 and 25. As noted the pathway sections may be "U"-shaped channels; upwardly extending lips or curb sections on the pathways are shown at **9*a* and 9*b* and 10*a* and 10*b*. The right offset is shown as 9*c***.

Figure 4:
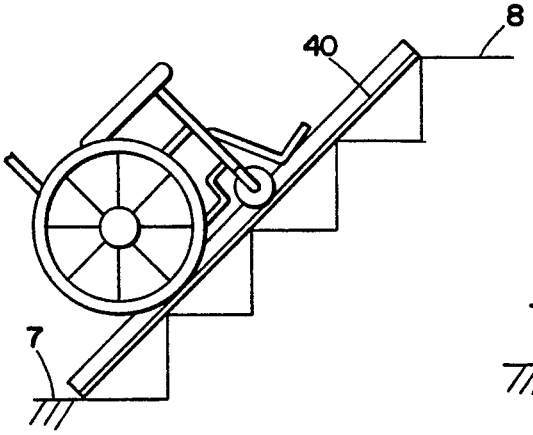
FIG. 4 is a cross-section of the unfolded means at section 3A—3A of FIG. 2.

When in use, the accessibility means has an advantage over a straight ramp placed over the same stair incline: the stairs remain available to the assistant and provide a normal footing surface, while the access means channels provide mechanical leverage up an inclined plan. The requirements of both the able-bodied assistant and the wheelchair for safe transit of the barrier are met: the stair barrier to the wheelchair is eliminated and is temporarily replaced by an inclined plane; the stair footing necessary for the assistant is, however, maintained; and a bi-functional passageway for both is created as shown in FIG. 4.

Figure 4A:
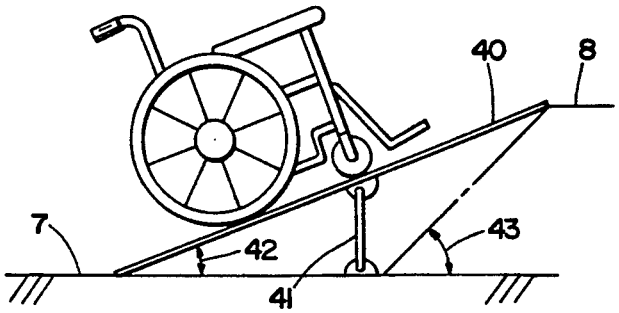
FIG. 4A shows in side view an extended access means reducing the slope gradient over a barrier.
Figure 8:
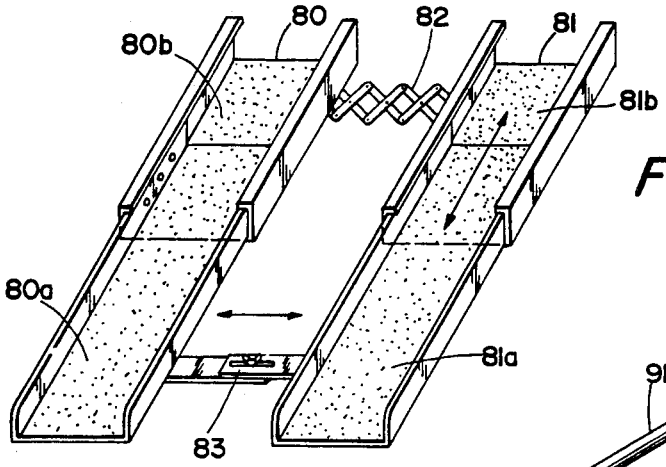
FIG. 8 shows a portable embodiment.

Normally, when a stair barrier is confronted, the wheelchair and occupant would be lifted and carried up the stairs, usually an awkward operation that requires at least two persons for adequate safety. While the access means directly over the stairs illustrated in FIG. 1 does not provide the 1:12 slope conventionally regarded as necessary for independent access, the channeled access means will provide a slope corresponding at least to the riser:stair tread gradient which is almost always greater than 1:1. If desired, however, the gradient of the access means does not need to replicate the stair gradient. Pathways extended in length, such as shown at 40 in FIG. 4A may be provided and such pathways may be fitted with optional retractable support legs 41. In the embodiment of FIG. 4A, the slope of the access means 42 is less steep than the slope 43 of the stair:riser tread slope. Such an extended pathway may be a single extended channel stored and hinged vertically against the wall at either end (using a dual axis hinging system such as that used for retractable airline food service trays), or in the manner longitudinally against the wall in a correspondence with the stair gradient as shown in FIG. 1. Alternatively, an extendable pathway such as shown in FIG. 8 may be used in such an instance.

As used herein, a "channel" refers to a pathway for the side wheels of a wheelchair and includes a flat and narrow extended surface; an actual "U"-shaped channel may be preferably used at one or both sides of the access means. An upwardly extending lip or curb (approximately one-half to one inch (0.5–1.0") high) on the inside edges of at least one of the channels) is a preferred safety means which reduces the possibility of a deviation of the wheelchair from the path and a consequent fall. In addition, a lip or curb provides additional longitudinal strength in the pathway.

Figure 5:
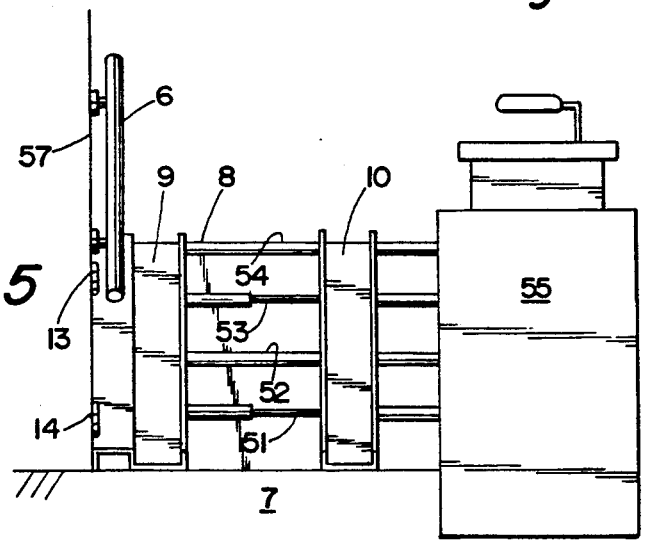
FIG. 5 shows the access means installed at a restaurant having stairs leading to a dining room.

FIG. 5 illustrates an architecturally appropriate design for an entrance to a hotel dining room. (The stairs, 51, 52, 53 and 54 may be up or down.) The maitre d' station is shown at 55 and access means of the application 56 is folded against wall 57.

Figure 6:
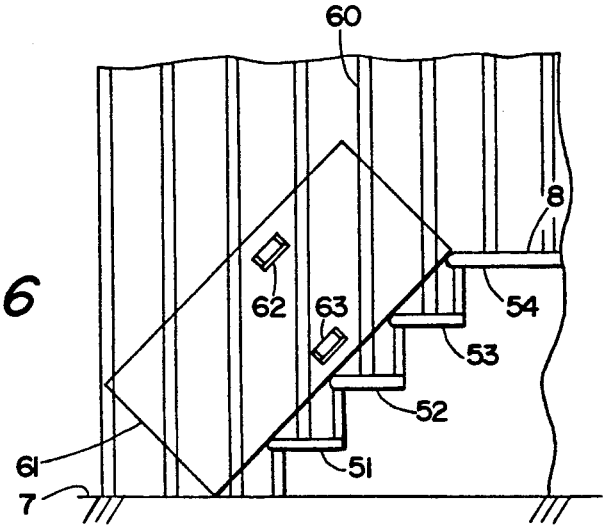
FIG. 6 shows a wall enclosure concealing the access means when not in use.

If the mechanism is to be concealed, ( appropriate for example, in historical venues such as Historical Williamsburg), a screen, having a design appropriate to a presenting wall may be installed over the folded access means. FIG. 6 represents an application of the access means of FIG. 5 and shows the manner in which the access means can be adapted to room decor. In FIG. 6 the walls include a design or color 60 which is copied on the cover portion of the access means cabinet 61. A handle for unfolding the access means is attached to the upper 72 or lower 73 portion of the cabinet cover. Whether the cover raises up or down is a matter of design configuration.

Figure 7:
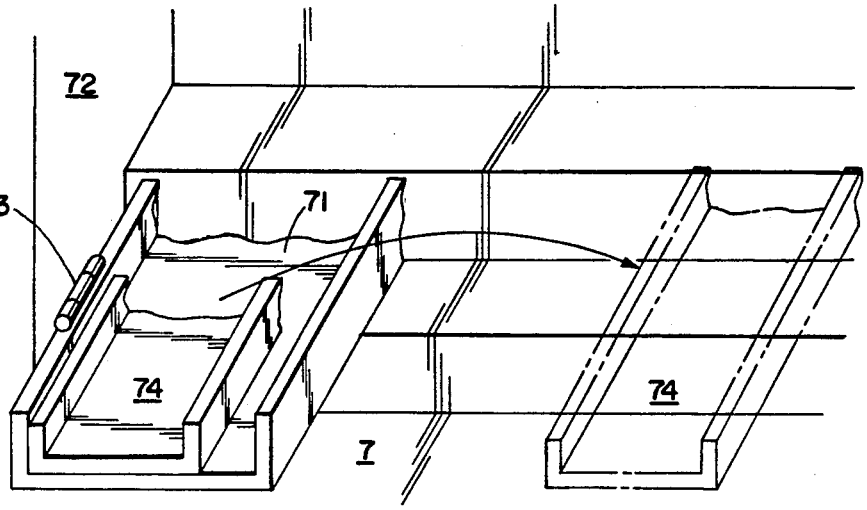
FIG. 7 illustrates that in one form, one side of the access means, may be nested in the other for storage.

FIG. 7 illustrates a nested arrangement of access means channels. A first channel 81 is attached to the wall 82 by hinge means 83 and includes nested therein second access means 84 which can be taken out and deployed in alignment with the other side of wheelchair sidewheels when the first channel, which receives one side of the wheels is unfolded.

Preferred applications for the access means likely include stair barriers having more than one step. With a single step, the classic "tilt-back/push-forward" maneuver with an assistant is usually satisfactory. The invention provides an improvement, even in a single step application, by producing the mechanical advantage of an inclined plane for the wheelchair, while preserving unobstructed stair access for the assistant. Use of the access means to traverse a flight of stairs (one floor directly to another) is not preferred unless the stairs have a very moderate slope. The access means seems suited to a middle ground, i.e., the conventional grade elevation of approximately two, three or four or more steps which raise a floor level from ground for reasons of building code, drainage requirements, or other architectural purpose. Although operation of the device may appear simple, user training should be required for operators responsible for use of the device. User instructions may be posted adjacent the means and/or a call box provided at permanent installations. A lock or other such device will prevent unauthorized deployment of the means.

FIG. 8 shows a portable version of the access means, including longitudinally extensible paired channels 80 and 81 formed from inner and outer sliding members 80*a* and 80*b* and 81*a* and 81*b*. The channels are variable in spacing by lateral extension means such as scissor 82 or sliding means held in place by wing nut lock 83. Such a portable version extensible in length and (if necessary, width) would likely be considered a "universal" portable carried by the wheelchair user for application at different locations such as the user's different relatives' or acquaintances' different residences where stair barriers are all different and access is not otherwise provided at the locations. In a community where all homes are elevated to the same grad level (e.g. one, two or three steps up) but not all homes are accessible by a suitably graded 1:12 path, a "one-size-fits-all" access means could be carried conveniently by the wheelchair user for access to all neighborhood homes in compliance with the same design parameter and/or economically mass-produced and supplied to all community homes so that all homes have wheelchair access when needed.

Figure 9:
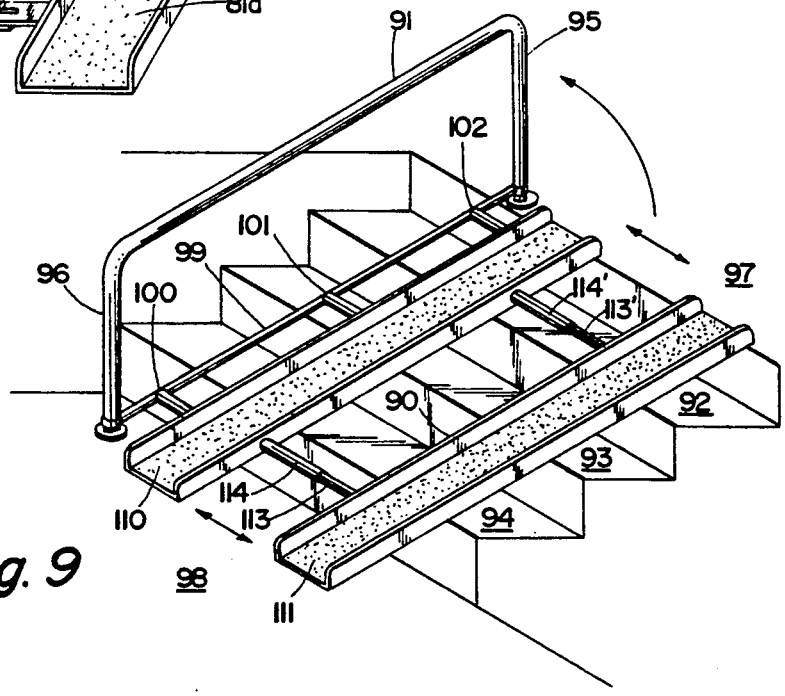
FIG. 9 shows the access means deployed in a swimming pool stairway.

In the installation illustrated at FIG. 9, the access means 90 is installed at a swimming pool adjacent the handrail 91 which otherwise assists an entry down several stairs 92,93,94 into the shallow end of the pool. The handrail posts 95 and 96 are conventionally anchored securely into the pool terrace 97 and pool bottom 98. A hinging means for the first pathway is formed from a tube or rod 99 connected between the handrail posts. A series of rings 100, 101, 102 connects the first pathway 110 to the tube or rod 99 (through spacing members, if required) so that the means can be folded up in vertical alignment with the posts when not in use. A suitable latch or other locking means will maintain the access means in fixed vertical position. The second pathway 111 is adjustably connected to the first pathway through extensible inner and outer sliding tube means shown at 113 and 114. (Use of this latter feature is optional depending on the number of differently configured wheelchairs expected to be encountered at the pool. The "universal" pathway width and separation referred to above may be equally appropriate.) A screen, ribbed or grid type pathway or other form of traction enhancing surface is useful in such a pool application.

As is evident many variations and applications for the wheelchair access means are possible without departing from the spirit and intent of the foregoing description.

What is claimed is:

1. Accessibility means for achieving the human assisted passage of a person in a four wheeled wheelchair, while in the chair, over a stair barrier comprising:

a barrier to be traversed;

a pair of separate spaced-apart longitudinally extended pathways, each pathway having a width defined by the sides of said pathway sufficient to accommodate the front and rear wheels of the wheels on one side of the wheelchair and a length sufficient to traverse the barrier, the space between the pathways being sufficient to permit the human assistant access to the stair of the barrier means, adjacent said barrier for supporting at least one of said pathways;

a side of at least one of said pathways being hinged to said supporting means such that the pathway may be securely disposed therefrom to traverse the barrier, and retracted from the barrier when the pathway is not required for passage;

the other of said pathways being disposed to traverse said barrier, parallel to and spaced apart from the one of said pathways, such that the one and the other pathways each traverse the barrier, and are each capable of receiving the front and rear side wheels of the wheels on each of one side of the wheelchair in the course of transport of the person in the wheelchair over the barrier, and the space between the spaced apart pathways is an opening which provides access to the footing surface of the stair for the human assistant.

2. The access means of claim 1 including a hinge means securing a side edge at the width of at least one of the pathways to the support adjacent the barrier in which the one of the pair of the spaced apart pathways is hingingly connected to the support adjacent the barrier essentially perpendicularly to the direction of the longitudinal extent of the pathway over the barrier.

3. The access means of claim 2 in which each of the pair of the spaced apart pathways is hingingly connected to a support adjacent the barrier.

4. The access means of claim 2 in which the other of the pair of pathways is of a width less than the width of the one of the pathways and is adapted to be nested in the one of said pathways for storage when not in use and is removable therefrom to be disposed to traverse the barrier when needed.

5. The access means of claim 2 in which the other of the pair of pathways is connected to the one of said pathways by a lateral connecting means between the pathways which means does not obstruct the access of the human assistant to the footing surface.

6. The access means of claim 2 in which the support adjacent the barrier is a wall and the distance of the one pathway from the wall is laterally adjustable.

7. The access means of claim 5 in which the separation distance between the pathways is adjustable.

8. The access means of claim 6 in which the lateral separation distance between the pathways is adjustable.

9. The access means of claim 1 or claim 2 including a cabinet enclosure for receiving therein one of the pathways, said cabinet being formed at a sidewall adjacent the barrier, in which cabinet at least one of the pathways may be maintained when the pathway is not in use.

10. The access means of claim 2 installed in a passageway having essentially parallel walls and including a cabinet for receiving therein the one and the other of the pathways at each opposite sidewall of the passageway in which cabinets the one and the other pathways may be respectively maintained when the pathways are not in use.

11. A temporarily deployed accessibility means for achieving the assisted passage of a person in a wheelchair while in the chair, and the passage of the person assisting the person in the wheelchair, over a barrier in a passageway including a barrier to be traversed:

a pair of spaced-apart extended pathways, each pathway being longitudinally disposed to traverse the extent of said barrier and adapted in width to accommodate the front and rear wheels of the wheels on one side of the wheelchair, said pathways being parallel to and separated from each other a sufficient lateral distance such that the pathways are capable of separately receiving the front and rear side wheels on each opposite side of the wheelchair, the separation distance between the pathways forming an opening permitting access to a footpath in the passageway for the assistant as the assistant assists the person in the wheelchair over the barrier means, adjacent said barrier for supporting at least one of said pathways, said pathways being temporarily deployed to traverse the barrier and secured temporarily to said supporting means for a period of time encompassing the passage, wherein one of the pathways of the pair and the support are connected by means for allowing rotatable movement of said pathway with respect to one or more than one axis of said support.

12. The access means of claim 11 in which the spaced apart pathways are extensible in length.

13. The access means of claim 12 in which the separation distance between the pathways is variably adjustable.

14. The access means of claim 1 or claim 11 including a post support and at least one of the pathways is affixed to the post support.

15. The means of claim 1 or claim 11 in which the barrier is a stair barrier and the pathways are sloped at an angle corresponding to the presenting slope of the stair barrier.

16. The means of claim 1 or claim 11 in which the barrier is a stair barrier and the pathways are sloped and the slope of the pathways is less than the presenting slope of the stair barrier.

17. The means of claim 1 or claim 11 or claim 24 in which at least one of the pathways includes an upwardly directed lip at a side of the width thereof, said lip preventing the wheels of the wheelchair from deviating from the pathway.

18. The means of claim 17 in which at least one of the pathways is formed from a square cornered "U" shaped channel.

19. The means of claim 1 or claim 11 in which the pathways include a traction enhancing surface.

20. The means of claim 19 in which the pathways are formed from a material having an upper surface in one of a grid, screen or ribbed pattern.

21. The means of claim 1 or claim 11 installed at a doorway and further including means accessible to the person in the wheelchair, for signaling a human assistant.

22. The means of claim 1 or claim 11 traversing a plurality of stairs.

23. The means of claim 22 in which the plurality of stairs is fewer than about six stairs.

24. Accessibility means for achieving the human assisted passage of a person in a four wheeled wheelchair, while in the chair, over a barrier comprising a barrier to be traversed:

a pair of separate spaced-apart longitudinally extended pathways, each pathway having a width sufficient to accommodate the front and rear wheels of the wheels on one side of the wheelchair and a length sufficient to traverse the barrier means, adjacent said barrier for supporting at least one of said pathways, one of said pathways being secured by a hinge means to said supporting means such that the pathway may be securely disposed thereto to traverse the barrier;

the other of said pathways being adapted to be disposed to traverse said barrier, parallel to and spaced apart from the one of said pathways, such that the one and the other pathways each traverse the barrier, and are each capable of receiving the front and rear side wheels of the wheels on each of one side of the wheelchair in the course of transport of the person in the wheelchair over the barrier; and being further adapted to be nested in the one of said pathways for storage when not in use, and removable therefrom when needed to be disposed to traverse the barrier.

* * * * *